US006371219B1

(12) United States Patent
Collins et al.

(10) Patent No.: US 6,371,219 B1
(45) Date of Patent: Apr. 16, 2002

(54) OILWELL PERFORATOR HAVING METAL LOADED POLYMER MATRIX MOLDED LINER AND CASE

(75) Inventors: William R. Collins, Burleson; David J. Leidel, Arlington; Jerry L. Walker, Fort Worth; Nathan Clark; James M. Barker, both of Mansfield, all of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/584,916

(22) Filed: May 31, 2000

(51) Int. Cl.[7] ..... E21B 25/00

(52) U.S. Cl. ..... 175/2; 175/4.53; 166/55; 102/311

(58) Field of Search ..... 175/2, 3.5, 4.5, 175/4.53, 4.55, 4.6; 166/297, 299, 55; 102/311, 312, 320, 517

(56) References Cited

U.S. PATENT DOCUMENTS 4,196,026 A * 4/1980 Walker et al. ..... 149/46
4,304,614 A * 12/1981 Walker et al. ..... 149/46
4,923,535 A * 5/1990 Waters et al. ..... 149/19.1
6,158,351 A * 12/2000 Mravic et al. ..... 102/517

* cited by examiner

*Primary Examiner*—Frank S. Tsay
(74) *Attorney, Agent, or Firm*—William M. Imwalle; Marlin R. Smith

(57) ABSTRACT

A shaped charge is provided which includes features enhancing its manufacturability. In a described embodiment, an oilwell perforator is provided which includes a case and a liner, at least one of which is a molding. The molding has a metal loaded polymer matrix.

20 Claims, 2 Drawing Sheets

OILWELL PERFORATOR HAVING METAL LOADED POLYMER MATRIX MOLDED LINER AND CASE

BACKGROUND OF THE INVENTION

The present invention relates generally to explosive shaped charges and, in an embodiment described herein, more particularly provides an oilwell perforator having a liner and/or case molded from a metal loaded polymer matrix.

Perforators are shaped charges specially configured for use in forming perforations extending from a wellbore and into a subterranean formation or zone. In general, perforators are specially configured to form either large diameter or deep perforations. Some perforators may achieve both, or neither, of these objectives. Furthermore, perforators have other goals, for example, reducing the amount of debris left in perforations and in wellbore by the perforators after they have been detonated, etc.

Perforators designed specifically to form large diameter perforations are typically made of a die stamped or deep drawn metal liner, and a machined steel or die cast zinc metal case. Perforators designed specifically to form deep perforations typically have liners made of die pressed and green or partially sintered metal powder. The cases are likewise machined steel or die cast zinc. Each of these has its disadvantages. For example, the deep drawing and die stamping processes are typically limited to producing liners with substantially constant wall thickness, the processes of die pressing and sintering metal powders, machining cases from steel barstock and die casting zinc cases are relatively expensive and/or time-consuming, especially when the cases have complex configurations, and zinc cases are reactive upon detonation and cause more damage to a perforating gun carrier than when steel cases are used.

Therefore, it may be clearly seen that a need exists for a perforator with enhanced manufacturability in terms of its economy and/or convenience, and which economically permits the use of complex shapes, for example, to refine the performance of the perforator. Such a perforator may also be useful in reducing damage to perforating gun housings and other downhole equipment, such as packers and pressure gauges.

SUMMARY OF THE INVENTION

In carrying out the principles of the present invention, in accordance with an embodiment thereof, an oilwell perforator is provided which includes a molding as the case and/or liner thereof. Associated methods are also provided. The perforator has enhanced manufacturability, the ability to assume relatively complex shapes, and is useful in reducing damage to perforating gun housings and other downhole equipment, such as packers and pressure gauges.

In one aspect of the present invention, the molding has a polymer matrix that is loaded with metal. The metal may be in powder form and may include one or a combination of copper, tungsten, lead, molybdenum, tantalum, iron, nickel, zinc, aluminum, or other metals. The molding may have a metal content of from approximately 20% to approximately 95% by weight.

In another aspect of the present invention, the polymer matrix m a y be any of a wide variety of polymer materials, including fluorocarbons, polybutadienes, polymides, nylons, phenolics, polyesters, polyphenylene sulfide, polyether sulfone, etc.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
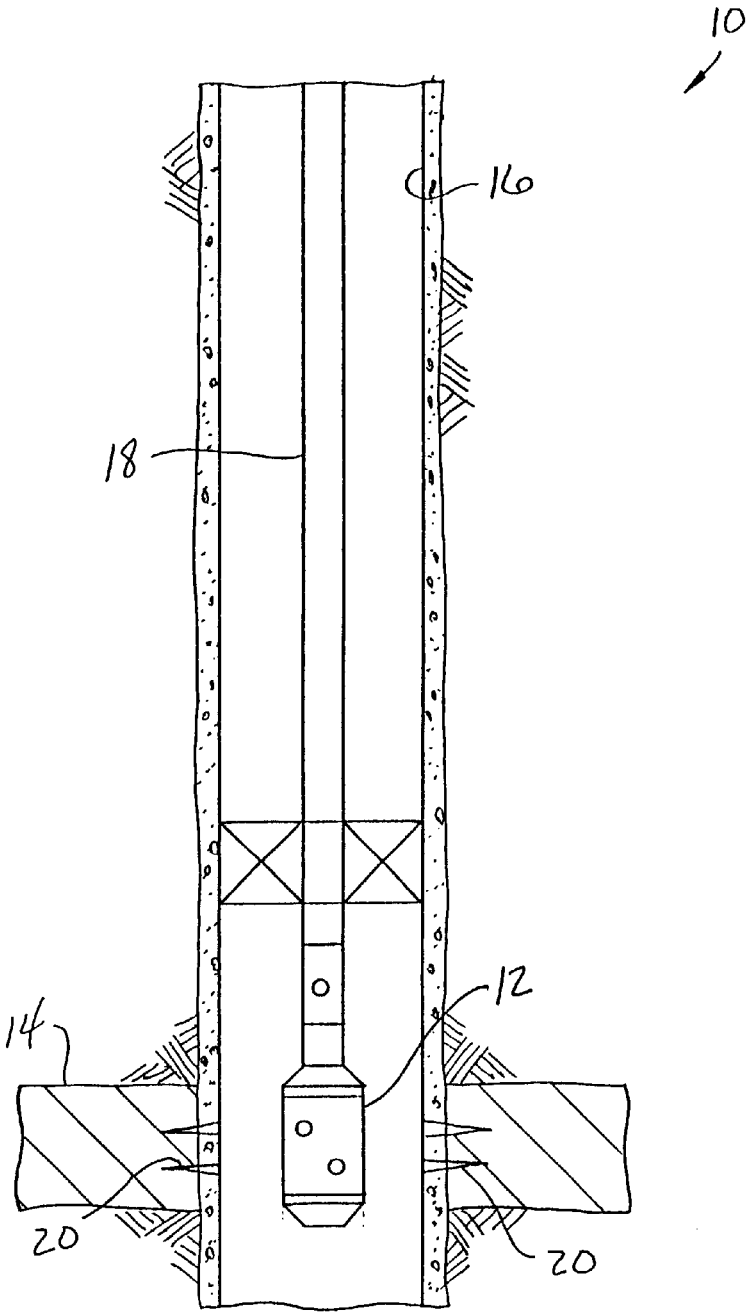
FIG. 1 is a schematic partially cross-sectional view of a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

In the method 10, a perforating gun 12 is conveyed into a wellbore 16 and positioned opposite a formation or zone 14. As depicted in FIG. 1, the gun 12 is conveyed on a tubular string 18, but other conveyances, such as wireline, etc., may be used.

The perforating gun 12 is fired, detonating shaped charges known to those skilled in the art as perforators within the gun, and forming perforations 20 extending from the wellbore 16 and into the zone 14. Fluid may now be flowed between the well bore 16 and the zone 14. However,it is to be clearly understood that principles of the present invention may be incorporated in other methods in which fluid flow between a wellbore and a zone is not the intended or actual result. For example, shaped charges may be used in wells to perforate tubing, provide detonation transfer between guns, etc.

Figure 2:
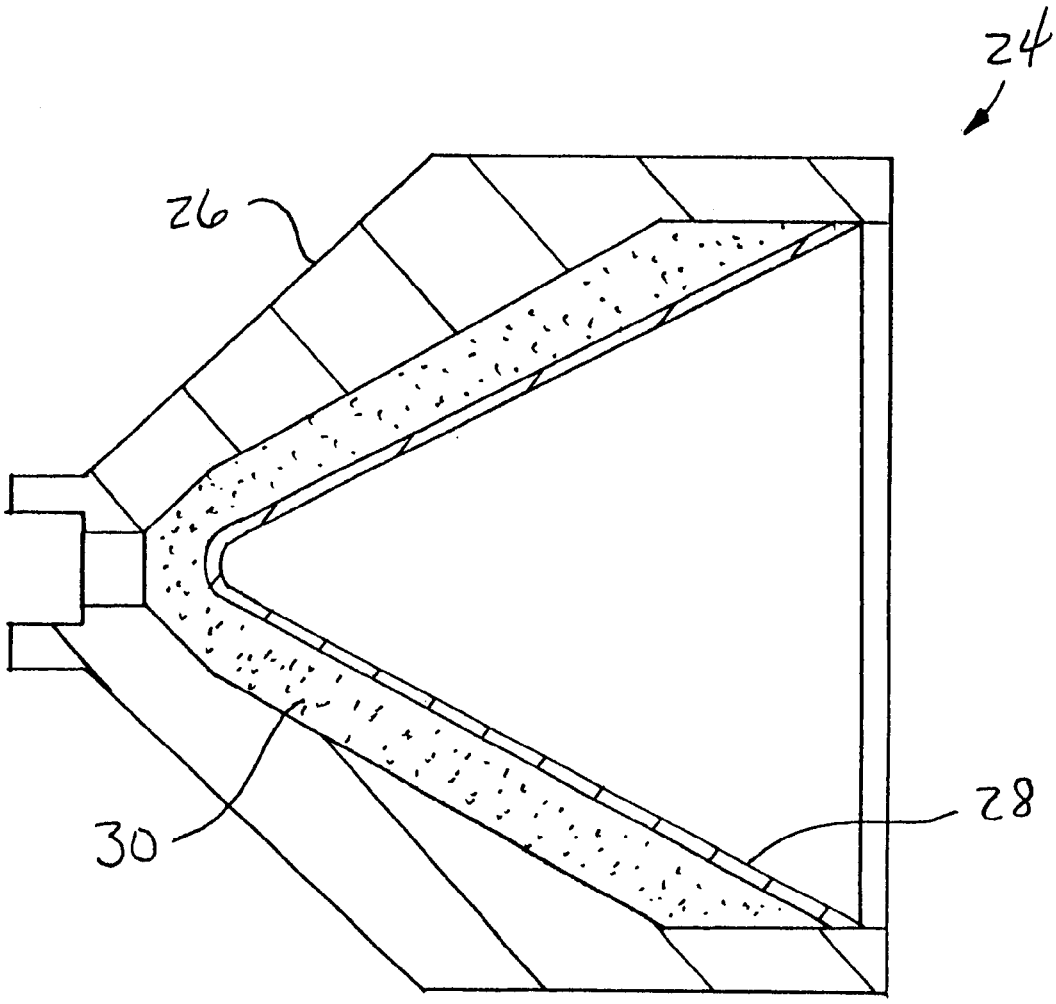
FIG. 2 is an enlarged scale cross-sectional view of a perforator usable in the method of FIG. 1.

Referring additionally now to FIG. 2, a perforator 24 embodying principles of the present invention is representatively illustrated. The perforator 24 may be used in the method 10 in the gun 12, or may be used in other methods. Additionally, aspects of the perforator 24 described herein may be incorporated into other types of shaped charges, without departing from the principles of the present invention.

The perforator 24 includes an outer case 26, an inner liner 28 and an explosive material 30 retained between the case and liner. The liner 28 is formed from any of a variety of materials, such as deep drawn or die stamped sheet metal, or die pressed and fully or partially sintered metal powder. However, the liner 28 is preferably a molding which includes a metal loaded polymer matrix.

As used herein, the term "matrix" means a material in which another material is dispersed, and the term "loaded" means contained within. Thus, the liner 28 molding includes a polymer material in which metal is dispersed.

The metal in the polymer matrix may be in the form of a powder, or a combination of powders. The metal may be copper, tungsten, lead, molybdenum, tantalum, nickel, iron, zinc, aluminum, etc., or a combination of metals. Of course, it is not necessary for the metal to be in powder form, although powder is convenient for mixing with the polymer matrix in the molding process. Furthermore, other metals and other types of metals may be used without departing from the principles of the present invention.

It is to be clearly understood that it is not necessary for the liner 28 to be made entirely of a molding, or for the molding to comprise only the liner. For example, the molding could be shaped so that it includes features for attaching the liner 28 to the case 26, etc. Additionally, the liner 28 may have portions thereof which are not molded, or which are not molded of a metal loaded polymer matrix.

The case 26 is formed from any of a variety of materials, including steel or die cast zinc, etc. However, the case 26 is preferably a molding which includes a metal loaded polymer matrix. The case 26 molding m ay be made of the same material as described above for the liner 28 molding.

It is to be clearly understood that it is not necessary for the case 26 to be made entirely of a molding, or for the molding to comprise only the case. For example, the molding could be shaped so that it includes features for mounting the perforator 24 in the gun 12, etc. Additionally, the case 26 may have portions thereof which are not molded, or which are not molded of a metal loaded polymer matrix.

From the foregoing, then, it will be appreciated that the perforator 24 may be constructed with the case 26 and/or liner 28 including a molding. The molding preferably has a metal loaded polymer matrix. Of course, both the case 26 and liner 28 may be integrally formed in a single molding, the molding may form either the case or liner, or a portion thereof, and a portion of the other, etc., without departing from the principles of the present invention.

The polymer matrix may be made of any polymer material, for example, fluorocarbons, such as polytetrafluoroethylene, polybutadienes, polymides, nylons, phenolics, polyesters, polyphenylene sulfide (which may be glass or mineral filled), polyether sulfone, etc. However, it is preferred that the polymer matrix exhibit characteristics suitable for downhole use, such as resistance to high temperatures, etc.

The metal in the molding is preferably from approximately 20% to approximately 95% by weight of the molding. This metal content is considered sufficient, depending upon the density of the metal, etc., in the instance of the case 26 for adequately resisting the force generated when the explosive 30 is detonated to thereby prevent damage to the gun 12 carrier, and in the instance of the liner 28, for producing an acceptable metal jet. However, it is to be clearly understood that any metal content proportion may be used, without departing from the principles of the present invention. For example, the molding may have any metal content which is less than or equal to approximately 95% by weight, or any metal content which is greater than or equal to approximately 20% by weight.

It will be readily appreciated that, by using a metal loaded polymer matrix molding, the applicants have solved the problem of reducing debris resulting from detonation of a perforator. For example, if the case 26 is made of a molding with a metal loaded polymer matrix, it will be reduced to small powder fragments of the molding when the perforator 24 is detonated, which fragments should not interfere with normal operations in a well.

Additionally, it will be readily appreciated that the applicants have solved the problem of manufacturing perforators economically, conveniently and with complex shapes. This is due to the fact that it is far easier and less time-consuming to produce a complex shaped molding than it is to produce a similarly shaped machined, deep drawn, die stamped or die cast part.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A shaped charge, comprising:

an outer case;

an inner liner; and an explosive material retained between the case and the liner, and wherein at least one of the case and the liner is a molding having a polymer matrix with metal therein.

2. The shaped charge according to claim 1, wherein the metal is less than or equal to approximately 95% by weight of the molding.

3. The shaped charge according to claim 1, wherein the metal is greater than or equal to approximately 20% by weight of the molding.

4. The shaped charge according to claim 1, wherein the metal is from approximately 20% to approximately 95% by weight of the molding.

5. The shaped charge according to claim 1, wherein the metal is at least one of copper, tungsten, lead, molybdenum, tantalum, zinc, aluminum, nickel and iron.

6. The shaped charge according to claim 1, wherein the metal is a powder.

7. The shaped charge according to claim 6, wherein the metal powder is at least one of copper, tungsten, lead, molybdenum, tantalum, zinc, aluminum, nickel and iron.

8. The shaped charge according to claim 1, wherein the polymer matrix is selected from fluorocarbons, polybutadienes, polyimides, nylons, phenolics, polyesters, polyphenylene sulfide and polyether sulfone.

9. A perforator for forming a perforation in a well, the perforator comprising:

a molding having a metal loaded polymer matrix, the molding being included as at least a part of at least one of a case and a liner of the perforator.

10. The perforator according to claim 9, wherein the polymer matrix is selected from fluorocarbons, polybutadienes, polyimides, nylons, phenolics, polyesters, polyphenylene sulfide and polyether sulfone.

11. The perforator according to claim 9, wherein the polymer matrix is loaded with at least one of copper, tungsten, lead, molybdenum, tantalum, zinc, aluminum, nickel and iron.

12. The perforator according to claim 9, wherein the polymer matrix is loaded with a metal powder.

13. The perforator according to claim 12, wherein the metal powder is at least one of copper, tungsten, lead, molybdenum, tantalum, zinc, aluminum, nickel and iron.

14. The perforator according to claim 9, wherein the molding has a metal content of from approximately 20% to approximately 95% by weight.

15. A method of forming a perforation from a wellbore into a subterranean zone, the method comprising the steps of:

conveying a perforating gun into the wellbore, the perforating gun including a perforator having a molding with a metal loaded polymer matrix, the molding being included as at least a part of at least one of a case and a liner of the perforator;

positioning the perforating gun opposite the zone; and detonating the perforator, thereby forming the perforation.

16. The method according to claim 15, wherein in the conveying step, the polymer matrix is selected from fluorocarbons, polybutadienes, polyimides, nylons, phenolics, polyesters, polyphenylene sulfide and polyether sulfone.

17. The method according to claim 15, wherein in the conveying step, the polymer matrix is loaded with at least one of copper, tungsten, lead, molybdenum, tantalum, zinc, aluminum, nickel and iron.

18. The method according to claim 15, wherein in the conveying step, the polymer matrix is loaded with a metal powder.

19. The method according to claim 18, wherein in the conveying step, the metal powder is at least one of copper, tungsten, lead, molybdenum, zinc, aluminum, tantalum, nickel and iron.

20. The method according to claim 15, wherein in the conveying step, the molding has a metal content of from approximately 20% to approximately 95% by weight.

* * * * *